US006216407B1

(12) United States Patent
LeBlanc

(10) Patent No.: US 6,216,407 B1
(45) Date of Patent: Apr. 17, 2001

(54) MITERLESS MOLDING CORNER PIECE FOR ROUNDED INSIDE AND OUTSIDE CORNERS

(76) Inventor: Donald LeBlanc, 3907 - 23 Avenue SW, Calgary, Alberta (CA), T3E 0J9

( * ) Notice: Subject to any disclaimer, the term of this patent is extended or adjusted under 35 U.S.C. 154(b) by 0 days.

(21) Appl. No.: 09/385,856

(22) Filed: Aug. 30, 1999

(51) Int. Cl.[7] ..... E04B 2/00

(52) U.S. Cl. ..... 52/287.1; 52/288.1

(58) Field of Search ..... 52/287.1, 288.1, 52/716.1, 455, 459, 469; 312/137, 140.4

(56) References Cited

U.S. PATENT DOCUMENTS

| | | | | |
|---|---|---|---|---|
| D. 273,047 | | 3/1984 | L'loyd-Jones . | |
| D. 275,036 | | 8/1984 | Lloyd-Jones | D52/79 |
| 2,921,352 | * | 1/1960 | Pfeifle | 52/287.1 X |
| 3,222,837 | * | 12/1965 | Daley | 52/287.1 |
| 3,667,177 | | 6/1972 | Biela | 52/278 |
| 3,707,061 | * | 12/1972 | Collette et al. | 52/288.1 |
| 3,828,499 | | 8/1974 | Leddy | 52/278 |
| 3,942,295 | | 3/1976 | Schacht | 52/288.1 |
| 3,956,861 | | 5/1976 | Rasmussen | 52/287.1 |
| 4,052,830 | | 10/1977 | Smith | 52/288.1 |
| 4,150,517 | | 4/1979 | Warner, Sr. | 52/288.1 |
| 4,565,041 | | 1/1986 | Wendt | 52/288.1 |
| 4,569,171 | | 2/1986 | Kuhr et al. | 52/242 |
| 4,598,516 | | 7/1986 | Groshong | 52/241 |
| 4,644,991 | | 2/1987 | Boyd | 160/38 |
| 4,648,225 | | 3/1987 | Waddell | 52/288.1 |
| 4,706,427 | * | 11/1987 | Zeilinger | 52/287.1 |
| 4,912,899 | | 4/1990 | Plasker et al. | 52/241 |
| 5,001,877 | | 3/1991 | Edwards | 52/288.1 |
| 5,010,703 | | 4/1991 | Pearlman et al. | 52/288.1 |
| 5,086,598 | | 2/1992 | Weldy | 52/288.1 |
| 5,109,641 | | 5/1992 | Halan | 52/62 |
| 5,165,209 | | 11/1992 | Bischel et al. | 52/484 |
| 5,193,322 | | 3/1993 | Wood | 52/718.01 |
| 5,199,237 | | 4/1993 | Juntunen | 52/288.1 |
| 5,313,755 | | 5/1994 | Koenig, Jr. | 52/255 |
| 5,463,835 | | 11/1995 | Wood | 52/288.1 |
| 5,469,682 | | 11/1995 | Knight | 52/718.01 |
| 5,511,332 | | 4/1996 | Sturkre et al. | 40/642 |
| 5,557,895 | | 9/1996 | Bendrell | 52/220.7 |
| 5,592,797 | | 1/1997 | Logan et al. | 52/288.1 |
| 5,711,123 | | 1/1998 | Lamont et al. | 52/287.1 |
| 5,729,933 | | 3/1998 | Strength | 52/96 |
| 5,740,642 | | 4/1998 | Koenig, Jr. et al. | 52/255 |
| 5,752,353 | | 5/1998 | Koenig et al. | 52/255 |
| 5,802,790 | | 9/1998 | Lamont et al. | 52/288.1 |
| 5,809,718 | | 9/1998 | Wicks | 52/287.1 |
| 5,809,901 | * | 9/1998 | Gutzmer | 312/140.4 X |
| 5,863,369 | | 1/1999 | Clarke et al. | 156/201 |
| 5,894,701 | | 4/1999 | Delorne | 52/801.11 |

FOREIGN PATENT DOCUMENTS

| | | | | |
|---|---|---|---|---|
| 846303 | * | 8/1960 | (GB) | 52/287.1 |

* cited by examiner

*Primary Examiner*—James O. Hansen
(74) *Attorney, Agent, or Firm*—David S. Thompson

(57) ABSTRACT

A miterless molding corner piece is adaptable for the formation of either rounded inside or outside corners, and may also be adapted for use with cornice, crown, baseboard or other molding types. The corner piece provides a curving segment having either an inside or an outside curve. The segment provides a surface which is sized and shaped to uniformly contact the surface of portions of the first and second wall surfaces and the rounded wall corner. The rounded wall corner may form either a square inside (90 degree) or a square outside (270 degree) corner, but may be almost any angle from less than 90 to more than 270 degrees. Opposed top and bottom surfaces are adjacent to the inside surface. In a cornice or crown application, the top surface is adjacent to the ceiling. In a baseboard molding application, the bottom surface is adjacent to the floor. In a preferred version, first and second straight segments extend from first and second ends, respectively, of the curving segment. The straight segments are sized to make a seamless connection with the first and second molding segments covering the first and second wall surfaces. The curving segment and first and second straight segments each define a profiled surface which is styled to match the profiled surfaces of the first and second molding segments.

1 Claim, 4 Drawing Sheets

MITERLESS MOLDING CORNER PIECE FOR ROUNDED INSIDE AND OUTSIDE CORNERS

CROSS-REFERENCES

There are no applications related to this application filed in this or any foreign country.

BACKGROUND

It is standard practice to use baseboard moldings along the intersection of the floor and wall in residential and commercial construction. Similarly, cornice moldings are used at the intersection of the ceiling and walls. Crown moldings similarly cover the intersection of the ceiling and wall, but cover a narrow strip of the ceiling left uncovered by the cornice molding.

Where a 90-degree inside or outside corner is caused by the intersection of two adjacent walls, it is the well-known and established practice to miter-cut the adjacent molding strips to result in an end surface at 45-degrees to the length of the molding. With the surfaces cut at 45-degrees and positioned adjacent to each other, the molding strips form the required 90-degree angle. While this practice works well in theory, it is frequently the case that the workmanship of actual application contains visible flaws.

It is even more difficult to apply moldings to rounded "barrel" or "bull nose" corners. Such corners tend to lend a polished, classy look to new construction. However, the appearance is degraded by moldings which do not conform to the curvature of the wall. Since the wall is curved, it is common practice to cut short segments of straight molding and approximate the rounded corner corner. The use of short segments results in a number of seams defined between adjacent segments. This is unattractive, and detracts from the appearance of the molding.

This problem arises on both inside and outside corners, and with both baseboard molding on the floor and with cornice and crown molding on the ceiling.

For the foregoing reasons, there is a need for miterless molding system for angular and rounded inside and outside corners that results in a smooth, professional appearance in rounded-corner applications.

SUMMARY

The present invention is directed to an apparatus that satisfies the above needs. A novel miterless molding system for rounded inside and outside corners is disclosed that is adapted for use with cornice moldings, crown moldings, baseboard and other types of moldings. The molding system for rounded corners provides a flush, seamless connection about an inside or outside rounded corner, and mates to the straight segment portions of existing types of moldings.

The miterless molding corner piece 10 adapted for use on rounded inside or outside corners of the present invention provides some or all of the following structures.

(A) A curving segment 30 having an inside surface 33 defined to conform to the outside surface of a bull nose, barrel or similar rounded corner 300 of a wall surface. The inside surface may be defined to fit a corner of almost any angle, but is typically 90 degrees (i.e. an inside corner) or 270 degrees (i.e. an outside corner). The corner piece also defines an outside profiled surface 36 configured to conform to the profiled surface 401, 501 of adjacent straight molding segments.

(B) In a preferred version, first and second straight segments 70, 80 extend from the first and second ends 34, 35 of the curving segment 30. The first and second straight segments have inside surfaces 72, 82 defined to conform to first and second flat wall surfaces 100, 200 and have profiled surfaces 73, 83 configured to conform to the profiled surfaces of the first and second molding segments 400, 500 carried by the wall surfaces.

It is therefore a primary advantage of the present invention to provide a novel miterless molding system for rounded inside and outside corners that makes a seamless transition from the segments of straight molding carried by adjacent wall surfaces about a rounded corner.

Another advantage of the present invention is to provide a novel miterless molding system for rounded inside and outside corners that is one piece and which therefore does not require the manufacture of a plurality of segments of molding and which does not require the formation of a compound corner using the plurality of segments.

A still further advantage of the present invention is to provide a novel miterless molding system for rounded inside and outside corners that is easily and quickly installed with a lower skill level than would be required for installation of a compound corner.

DRAWINGS

These and other features, aspects, and advantages of the present invention will become better understood with regard to the following description, appended claims, and accompanying drawings where:

DESCRIPTION

Figure 1:
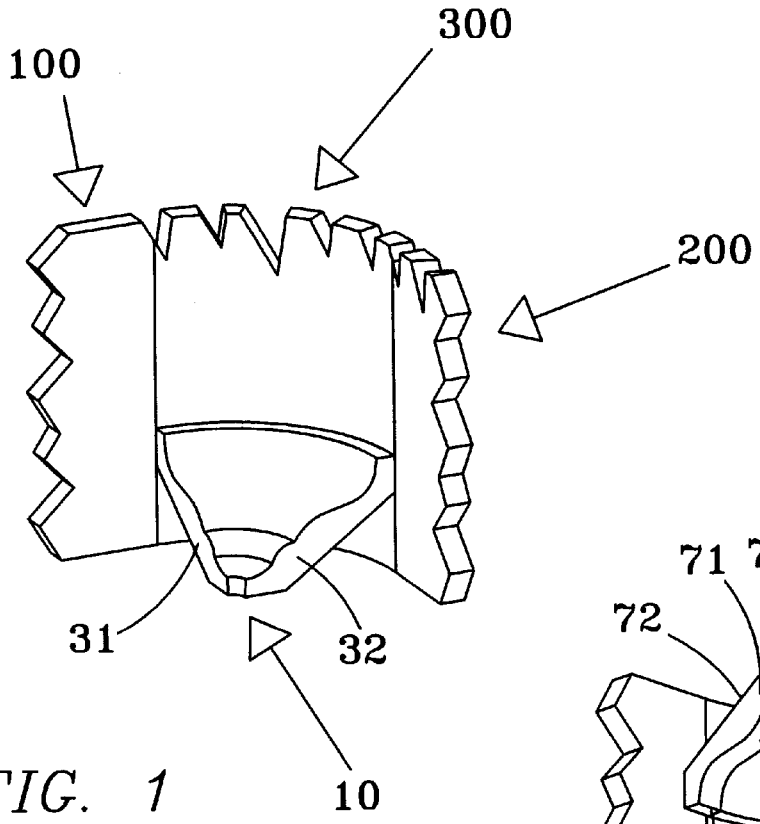
FIG. 1 is a perspective view of an inside corner supporting a miterless molding corner piece adaptable for use with baseboard molding.
Figure 2:
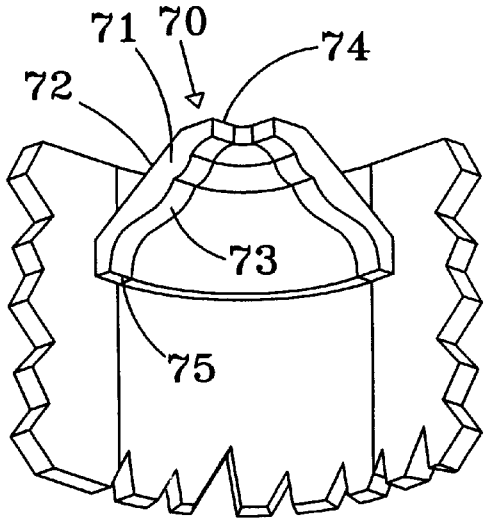
FIG. 2 is a perspective view of an inside corner supporting a miterless molding corner piece, having first and second straight segments extending from the first and second ends of the curving segment, adaptable for use with crown or cornice molding.
Figure 3:
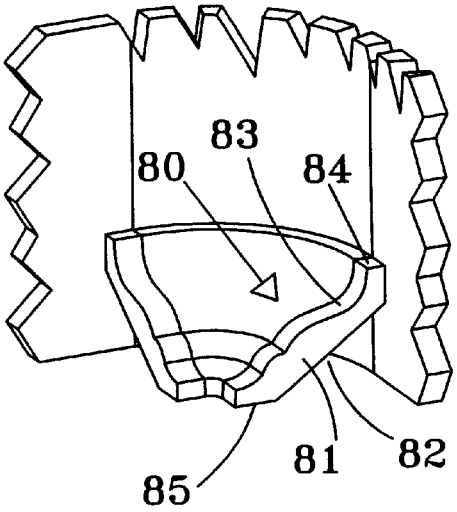
FIG. 3 is a perspective view of an inside corner supporting a miterless molding corner piece, having first and second straight segments extending from the first and second ends of the curving segment, adaptable for use with baseboard molding.

Referring in generally to the figures, a miterless molding corner piece 10 for rounded inside and outside corners constructed in accordance with the principles of the invention is seen. The molding corner piece is adapted for use where adjacent first and second wall surfaces 100, 200 meet at a bull nose, barrel or similar rounded wall corner 300, and where first and second conventional molding segments 400, 500 are applied to the wall surfaces. The molding segments may be baseboard, cornice, crown or of other molding types. The miterless molding corner piece includes a curving segment 30, which in two preferred embodiments includes either an inside curve 50 or an outside curve 60. The curving segment conforms to the outside surface of an inside or outside bull nose or similar wall corner 300. In a preferred configuration, first and second straight segments 70, 80 extend from the first and second ends, respectively, of the curving segment 30. An end surface 71, 81 of each of the straight segments is sized to mate in a seamless manner with the end surfaces 404, 504 of each molding segment.

As seen in FIGS. 1 through 8, first and second wall surfaces 100, 200 are typically oriented at an angle of 90 degrees (an inside corner) or 270 degrees (an outside corner). In a less common application, the wall surfaces may be oriented at a greater or lesser angle. Where the wall surfaces meet defining a corner 300 of less than 180 degrees, the corner is considered to be an inside corner. Where the angle between the wall surfaces is greater than 180 degrees the corner is considered to be an outside corner. Measurement of the angle between the surfaces is assumed to be made through the open area between the wall surfaces, and not through the material making up the wall itself.

In one style of construction, a "bull nose" or rounded wall corner 300 is constructed between adjacent wall surfaces 100, 200. Such a rounded surface results in a continuous curve defined between the adjacent wall surfaces, without the discontinuity of the sharp corner found in most construction. Such a bull nose corner typically has a diameter of approximately an inch.

In a similar style of wall construction includes a "barrel" corner. Such a corner 300 is substantially similar to the bull nose corner, except that its diameter is typically approximately a foot.

As seen in the figures, similar first and second molding segments 400, 500 are installed flush to the first and second wall surfaces. The molding segments may be baseboard molding, cornice or crown molding or other type of molding. It is a characteristic of molding that a profiled surface 401, 501 and optionally ornately defined top 402, 502 and bottom surfaces 403, 503 may be provided for reasons of esthetics.

Typically, the angle between the profiled surfaces 401, 501 of the first and second molding segments will be 90 or 270 degrees, if the corner is an inside or outside corner, respectively. However, a greater or lesser angle could be defined depending on the application.

Significantly, the end surfaces 404, 504 defined on the first and second molding segments are perpendicular to the length of the molding segments 400, 500. Such a surface is easily, rapidly and inexpensively formed by cutting the molding segment to a measured length without the need to calculate complex angles.

As seen in the figures, two versions of the miterless molding corner piece 10 for rounded inside and outside corners are disclosed, illustrating the two most preferred versions. However, an infinite number of versions of the invention could provide curving segments having any degree of inside or outside curve, from less than a 90 degree bend to more than a 270 degree bend, and having any style of profiled surface 36.

As seen in FIG. 1, a corner piece 10, having a curving segment 30 having an inside curve 50, fits between the end surfaces 404, 504, defining a smooth, continuous, flush fit between the profiled surface 36 of the curving segment 30 and the profiled surfaces 401, 501 of the molding segments. The inside curve 50 illustrates a 90 degree version of the invention.

Figure 8:
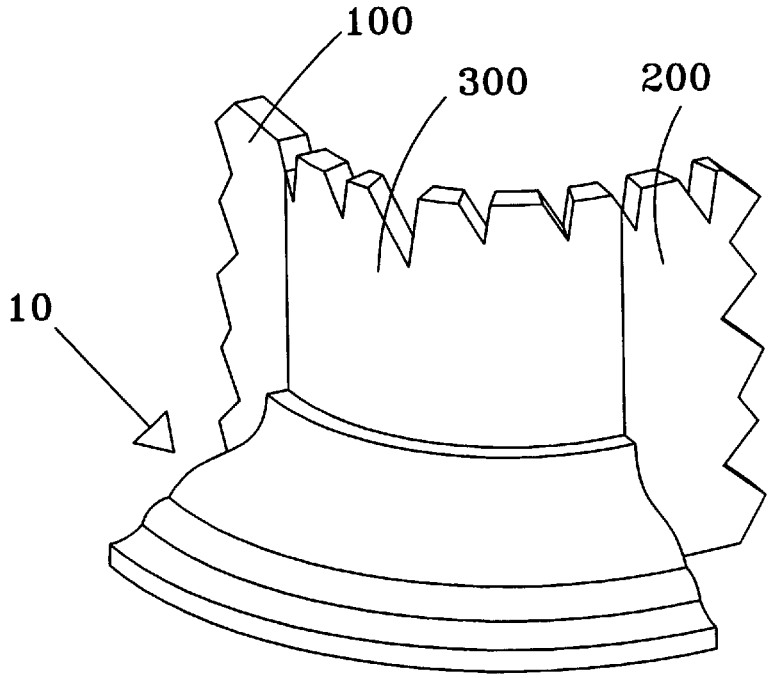
FIG. 8 is a perspective view of an outside corner supporting a miterless molding corner piece adaptable for use with baseboard molding.
Figure 9:
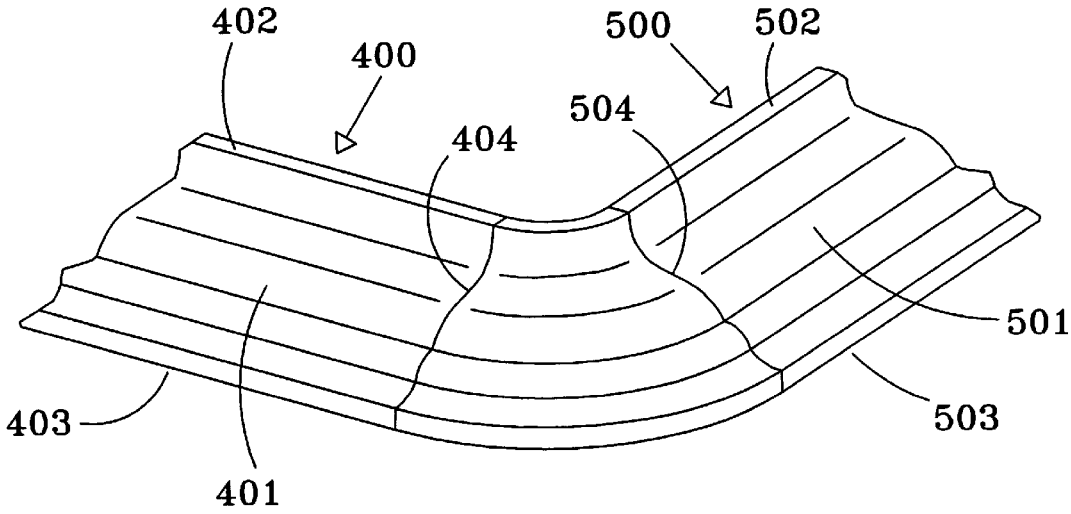
FIG. 9 is a perspective view of an outside corner supporting a miterless molding corner piece, also showing the adjacent pieces of baseboard molding to which it is attached.
Figure 10:
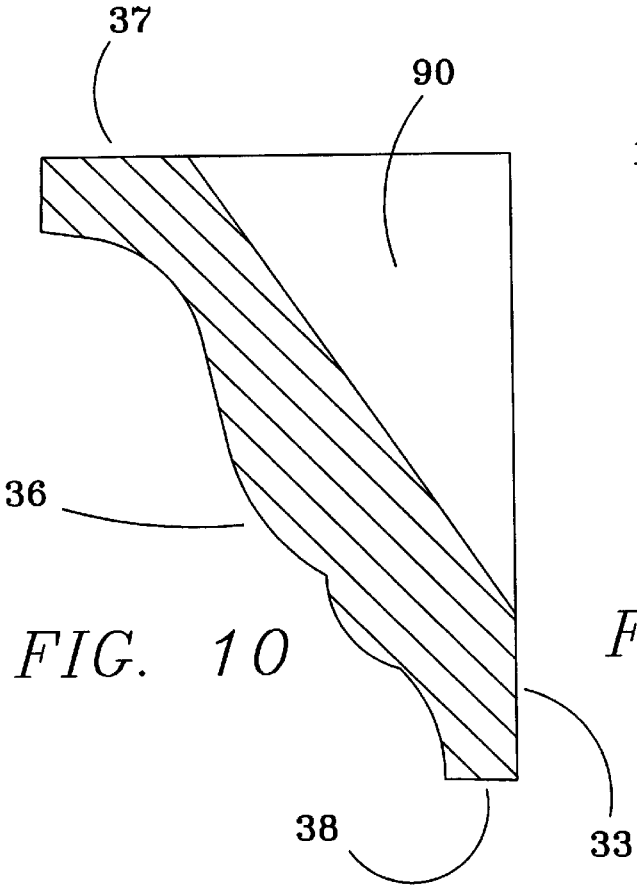
FIG. 10 is a cross-sectional view of a miterless molding corner piece adapted for use with crown and cornice moldings.
Figure 11:
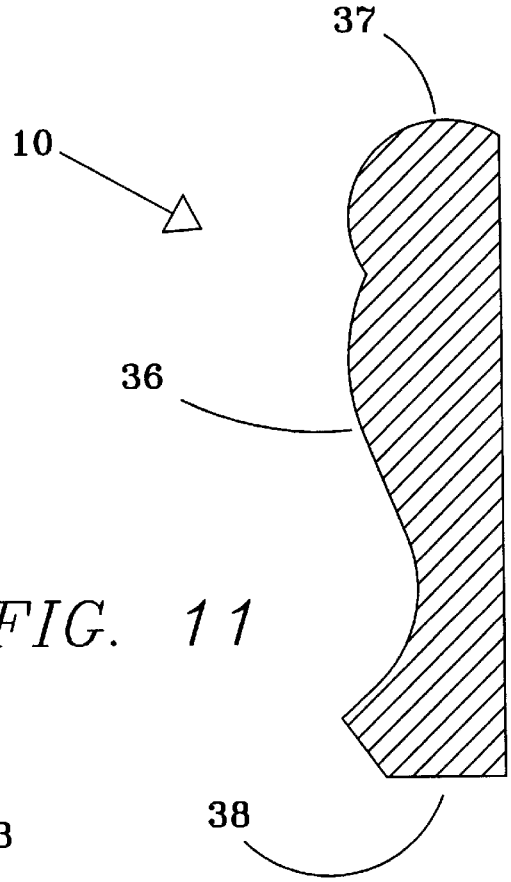
FIG. 11 is a cross-sectional view of a miterless molding corner piece adapted for use with baseboard moldings.

Similarly, as seen in FIGS. 8 and 9, a corner piece 10, having a curving segment 30 having an outside curve 60, fits between the end surfaces 404, 504, also defining a smooth, continuous, flush fit between the profiled surface 36 and the profiled surfaces 401, 501 of the molding segments. The outside curve 60 illustrates a 270 degree version of the invention.

As seen in FIGS. 1 through 4, an inside surface 33 provides the curve of the appropriate degree and radius to fit the wall corner 300. A profiled surface 36 and where appropriate top surface 37 and a bottom surface 38 are configured to match the profiled 401, 501, top 402, 502 and bottom surfaces 403, 503 of the first and second molding segments.

As seen in FIGS. 1 through 4, a corner piece 10 includes a curving segment 30 having an inside curve 50. The inside curve 50 defines a rounded 90 degree corner, but may define a corner having a greater or lesser angle. The radius of the corner, as well as the angle of the corner, should be selected to conform to the radius of the bull nose corner 300.

As seen in FIGS. 5 through 9, a corner piece 10 includes a curving segment 30 having an outside curve 60. The outside curve 60 defines a rounded 270 degree corner, but may define a corner having a greater or lesser angle. The radius of the corner, as well as the angle of the corner, should be selected to conform to the radius of the bull nose corner 300.

As seen in FIGS. 2, 3, 5 and 6, in a first version of the invention, similar first and second straight segments 70, 80 extend from the first end 34 and second end 35 of the curving segment 30. Each straight segment 70, 80 provides an inside surface 72, 82 which is generally planar and therefore fits flush against the wall surfaces 100, 200.

Continuing to refer to the figures, the contour or surface ornamentation of the profiled surface 73, 83 is defined to match the profiled surfaces 401, 501 of the first and second moldings 400, 500. Similarly, the top surfaces 74, 84 and bottom surfaces 75, 85 may also be contoured to match the surface ornamentation, if any, of the first and second moldings 400, 500.

Each straight segment 70, 80 defines one end surface 71, 81. The end surfaces 71 are perpendicular to the length of the straight segment, and are the same size and shape as the end surface 404, 504 of the molding segments 400, 500.

Figure 4:
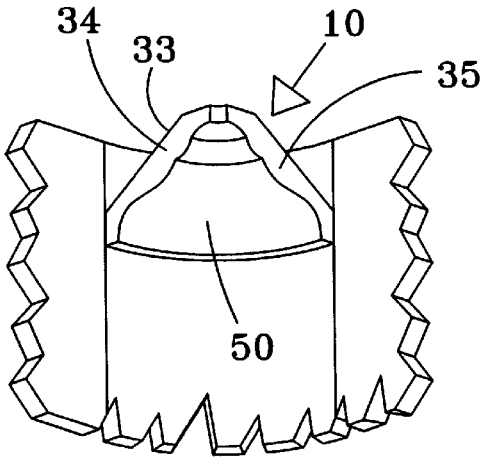
FIG. 4 is a perspective view of an inside corner supporting a miterless molding corner piece adaptable for use with crown or cornice molding.
Figure 5:
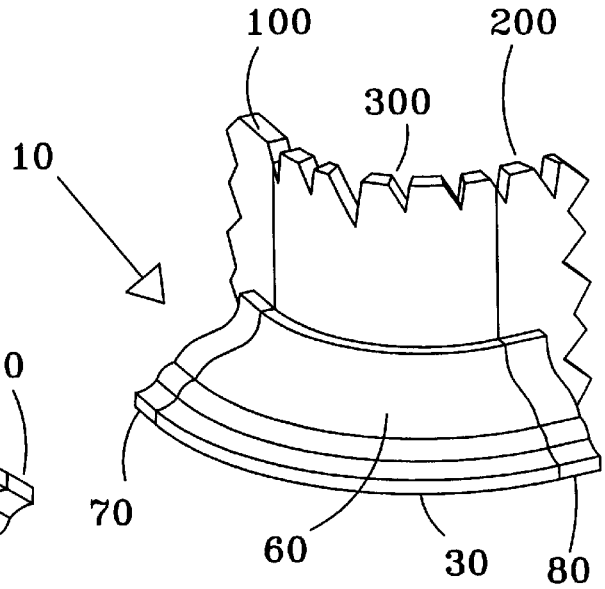
FIG. 5 is a perspective view of an outside corner supporting a miterless molding corner piece, having first and second straight segments extending from the first and second ends of the curving segment, adaptable for use with baseboard molding.
Figure 6:
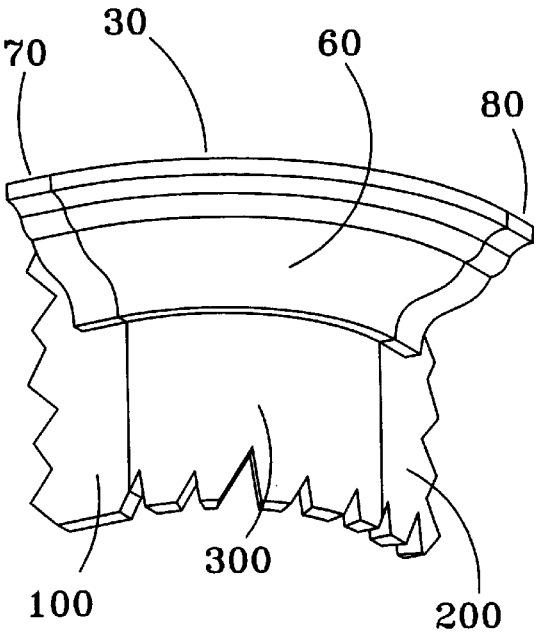
FIG. 6 is a perspective view of an outside corner supporting a miterless molding corner piece, having first and second straight segments extending from the first and second ends of the curving segment, adaptable for use with crown or cornice molding.
Figure 7:
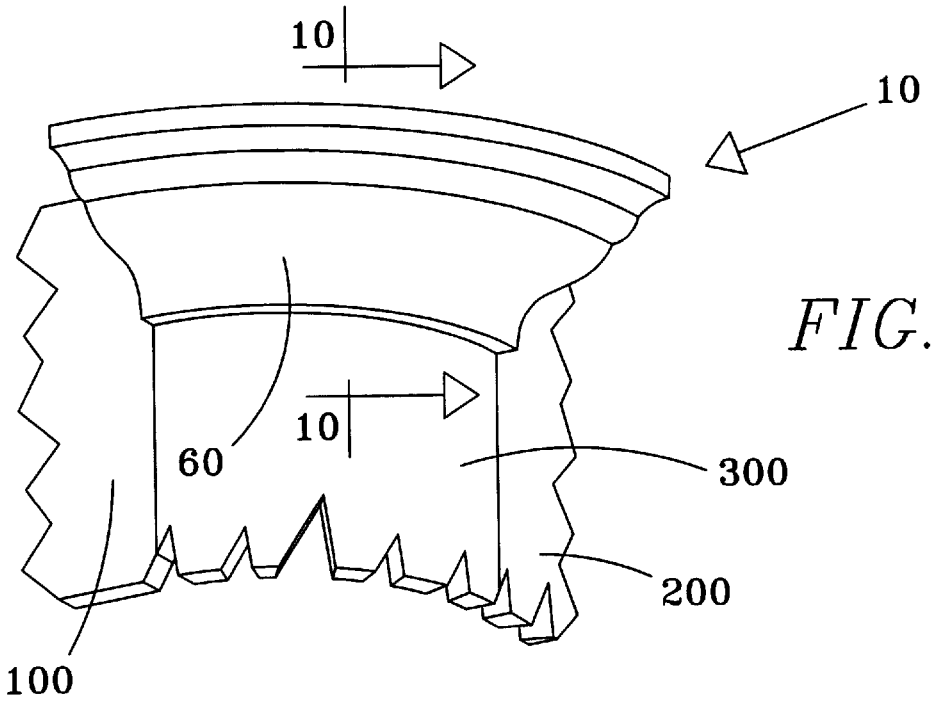
FIG. 7 is a perspective view of an outside corner supporting a miterless molding corner piece adaptable for use with crown or cornice molding.

As seen in FIGS. 1 and 4, in a version of the invention having an inside curve 50, and in FIGS. 7 and 8, in a version of the invention having an outside curve 60, first and second end surfaces 31, 32 are mounted flush against the end surfaces 404, 504 of the first and second molding segments 400, 500.

A preferred corner piece 10 is made of injection molded plastic or similar molded material. Alternatively, an extrusion process may be employed, using any appropriate material. As a still further alternative, other materials such as wood may be used. The profiled surface, top surface and bottom surface are molded or otherwise manufactured to match the profiled surfaces of the molding 400, 500. Due to the number of different molding types and styles, corner pieces of a variety of different styles could be designed to match.

Where injection molding is used, an internal webbing 90, or alternatively a solid interior, may be used. Webbing particularly allows the corner piece to be flexed slightly, if desired, during installation.

To use the corner piece 10, the corner piece is first installed about the corner 300. The corner piece may be installed using adhesive or other fastening means.

Where the first and second straight segments 70, 80 are present, these segments are installed on portions of the first and second wall surfaces 100, 200 which are adjacent to the corner 300.

The first and second molding segments 400, 500 are then installed in a manner that results in the end surface 404, 504 mounting flush with the end surface 71, 81 of each straight segment.

Where straight segments 70, 80 are not present on the corner piece 10, the end surfaces 404, 504 are mounted flush against the first and second end surfaces 31, 32.

The previously described versions of the present invention have many advantages, including a primary advantage of providing a novel miterless molding system for rounded inside and outside corners that makes a seamless transition from the segments of straight molding carried by adjacent wall surfaces about a rounded corner.

Another advantage of the present invention is to provide a novel miterless molding system for rounded inside and outside corners that is one piece and which therefore does not require the manufacture of plurality of segments of molding and which does not require the formation of a compound corner using the plurality of segments.

A still further advantage of the present invention is to provide a novel miterless molding system for rounded inside and outside corners that is easily and quickly installed with a lower skill level than would be required for installation of a compound corner.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while preferred 90 and 270 degree versions of the curving segment were disclosed, it is clear that any angle, from less than 90 to more than 270 could alternatively be used. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A corner piece for attachment to first and second wall surfaces and a rounded wall corner defining a continuous curve between the first and second wall surfaces, the corner piece comprising:

(A) a curving segment, comprising:
- (a) a rounded inside surface, having a curvature equal to a curvature of the rounded wall corner, whereby the rounded inside surface is in contact with the rounded wall corner;
- (b) top and bottom surfaces adjacent to the inside surface; and
- (c) a profiled surface adjacent to the top and bottom surfaces;

(B) a first straight segment, extending from a first end of the curving segment, the first straight segment comprising:
- (a) an inside surface;
- (b) top and bottom surfaces adjacent to the inside surface;
- (c) a profiled surface adjacent to the top and bottom surfaces defining a smooth, continuous, flush fit with the profiled surface of the curving segment; and
- (d) an end surface adjacent to the profiled surface; and (C) a second straight segment, extending from a second end of the curving segment, the second straight segment comprising:
- (a) an inside surface;
- (b) top and bottom surfaces adjacent to the inside surface;
- (c) a profiled surface adjacent to the top and bottom surfaces defining a smooth, continuous, flush fit with the profiled surface of the curving segment; and
- (d) an end surface adjacent to the profiled surface.

* * * * *